US007966913B2

(12) United States Patent
Vollenweider

(10) Patent No.: US 7,966,913 B2
(45) Date of Patent: Jun. 28, 2011

(54) HAND TOOL

(76) Inventor: Edgar G. Vollenweider, Slidell, LA (US)

( * ) Notice: Subject to any disclaimer, the term of this patent is extended or adjusted under 35 U.S.C. 154(b) by 0 days.

(21) Appl. No.: 12/229,895

(22) Filed: Aug. 28, 2008

(65) Prior Publication Data

US 2010/0050824 A1 Mar. 4, 2010

(51) Int. Cl.
*B25B 13/08* (2006.01)
*B25B 23/16* (2006.01)

(52) U.S. Cl. ..... 81/120; 81/177.1

(58) Field of Classification Search ..... 81/120, 81/176.1, 177.1, 489; D8/21, 27, 28
See application file for complete search history.

(56) References Cited

U.S. PATENT DOCUMENTS

| | | | | | |
|---|---|---|---|---|---|
| 172,155 | A * | 1/1876 | North | 81/177.1 |
| 359,400 | A * | 3/1887 | Mosher | 81/489 |
| 464,084 | A * | 12/1891 | Robinson | 81/176.1 |
| 522,181 | A * | 6/1894 | Neal | 81/489 |
| D27,471 | S * | 8/1897 | Freas | D8/28 |
| D30,115 | S * | 1/1899 | Hill | D8/28 |
| 1,168,185 | A * | 1/1916 | Fleck | 81/439 |
| 5,315,724 | A * | 5/1994 | Trujillo et al. | 7/145 |
| 2004/0123703 | A1 * | 7/2004 | Hsien | 81/177.1 |
| 2004/0244545 | A1 * | 12/2004 | Stinnissen et al. | 81/489 |
| 2007/0028727 | A1 * | 2/2007 | Schiller | 81/177.3 |

* cited by examiner

*Primary Examiner* — David B Thomas
(74) *Attorney, Agent, or Firm* — Keaty Law Firm, LLC

(57) ABSTRACT

A hand tool device is provided that stops the user from banging knuckles/hands into other nearby structures. The hand tool, for instance a wrench, includes a knuckle-protecting wrench handle, a wrench jaw, and a throat positioned between and integrated with the knuckle-protecting wrench handle and the wrench jaw. The wrench jaw may be a fixed open-ended jaw, an adjustable jaw, a Stillson type jaw, or a Crescent type jaw. The handle has two spaced-apart handle sections that define an opening therebetween. The user grips one of the handle sections during operation of the hand tool, while positioning one or both hands in the central opening. The second handle section protects the user's hands during use.

10 Claims, 8 Drawing Sheets

HAND TOOL

BACKGROUND OF THE INVENTION

1. Field

The present invention relates to wrenches, and more particularly, to a wrench device with a knuckle protecting handle.

2. Background

Wrenches are available in a variety of designs. For example, some wrenches are open-ended wrenches which include a U-shaped cavity designed to fit around and engage hexagonal or polygonal fasteners. When using an open-ended wrench, the U-shaped cavity is placed around a hexagonal or polygonal fastener head or nut and, then while the user grips the handle of the wrench, rotates the handle of the wrench at a right angle to an axis of the head thereby rotating the fastener head in a direction that would loosen the fastener.

While wrenches are designed to be strong and durable, wrenches fail or cause distortions in the corners of the fasteners allowing the fastener to rotate within the U-shaped cavity. As a wrench is swung in a controlled manner, the wrench applies a force to the corners of the fastener head or nut to effectuate a turning motion by the fastener in a direction to loosen the fastener. However, in some instances, the wrench is rotated part way while applying a force to the corners of the fastener head. The torque applied to the fastener corners gives way such that the wrench slips abruptly. When using the wrench, the user oftentimes is applying such a strong force, that when the wrench slips abruptly, the user looses control of the wrench causing the user's knuckles to strike any nearby structures or obstructions.

Open-ended wrenches may have a fixed jaw or an adjustable jaw such as without limitation, Crescent and Stillson type wrenches. The adjustable jaw wrenches suffer from the same drawback. The adjustable jaw, although initially tightened around the fastener head, has a tendency to broaden under load causing the wrench to slip. Yet again, the user looses control of the wrench causing the user's knuckles to strike any nearby structures or obstructions.

Wrench type devices are also used in a variety of industrial setting. For example, for most chemical plants or processes a multitude of valves are needed to provide the flow of the process materials from one vessel, or a state, or a reactor to another, as well as, the valving of various other components to treat the process to it or to react with it. In any event, the multitude of valves frequently require heavy turning of the valve's wheel to open or close the valve as necessary in the operation of refinery reactors and any type of fluid processing using pipes, valves, vessels.

The turning of a valve's wheel is generally facilitated by using a wrench type device or a valve wrench. However, in this industrial setting there are many structures near the wheel valve that a normal wrench leaves the operator exposed to potentially injuring his knuckles/hands.

The present invention contemplates elimination of drawbacks associated with conventional wrenches and provision of a wrench device with a knuckle protecting handle to protect a user's knuckles and hands when turning hard-to-turn items.

SUMMARY OF THE INVENTION

It is an object of the invention to provide a hand tool with knuckle protection for a user's hands to stop the user from banging their knuckles/hands into other nearby structures.

An object of the invention is to provide a wrench device comprising a knuckle-protecting wrench handle, a gripping jaw, and a throat positioned between and integrated with the knuckle-protecting wrench handle and the gripping jaw.

These and other objects of the invention are achieved through a provision of a hand tool device that has an elongated handle formed as a ring-shaped body and defined by a pair of opposing handle sections. The handle sections are unitary connected to each other and converge to form a connecting member, or throat of the tool. A gripping member, such as a wrench jaw, is secured to the connecting member.

The handle sections are spaced apart and form a central opening configured and sized to allow a user to grip one of the handle sections, while the second handle section protects the user's hand during operation. In the exemplary embodiments described below the gripping member is a wrench jaw that is used for applying torque to a wheel, a nut, or other similar object that the user turns using the hand tool.

In one aspect, the handle sections are arranged in a non-parallel relationship to each other. The long handle sections increase the lever arm and facilitate the torque-applying task. One of the embodiments provides for a reinforcing member positioned between the handle sections in the central opening. The reinforcing member connects the handle sections and increases their resistance to a spreading force when the user pulls on one of the handle sections.

If desired, the central opening may have different dimensions at a proximate end than in a distant end. For instance, the distant end of the handle opening may have greater distance between the handle sections, allowing the user to position both hands in the handle opening.

In one aspect, the handle sections are formed with a continuous groove extending through the length of the handle sections. The groove allows reducing of the weight of the hand tool without substantially reducing its physical strength in resisting the torque forces applied to the handle section during use of the hand tool.

If the hand tool is a wrench device, as shown in the drawings, the gripping member may be a Stillson-type wrench jaw, or it can be a wheel jaw used for turning pipes and hand wheels, or a gripping jaw used to rotate fasteners.

The above and other objects and features of the present invention will become apparent from the drawings, the description given herein, and the appended claims.

BRIEF DESCRIPTION OF THE DRAWINGS

For a further understanding of the nature and objects of the present invention, reference should be had to the following description taken in conjunction with the accompanying drawings in which like parts are given like reference numerals.

DETAILED DESCRIPTION OF THE PREFERRED EMBODIMENT

Figure 1:
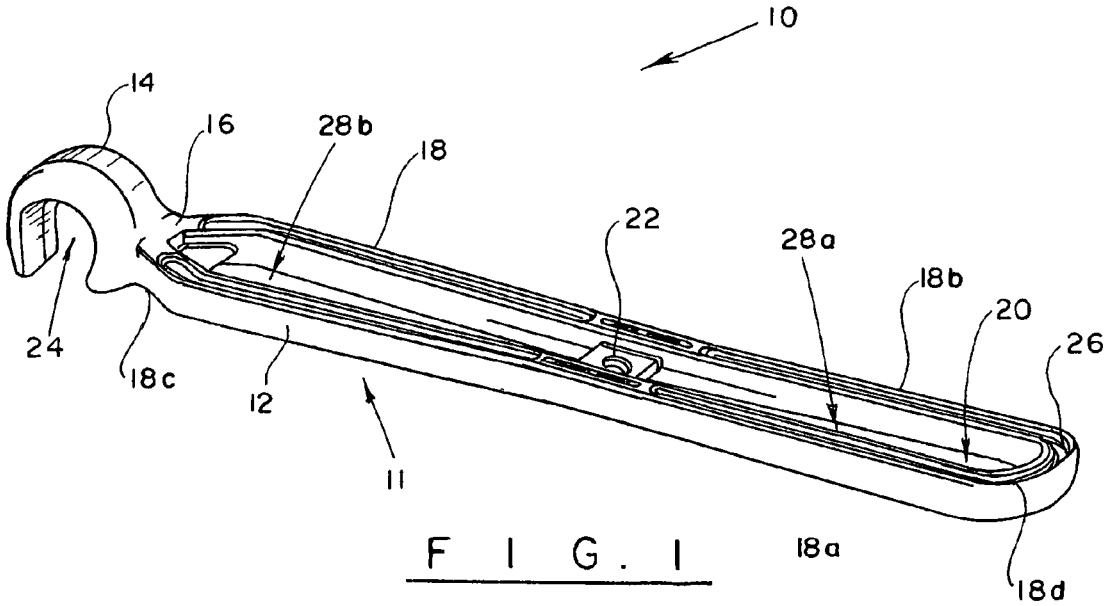
FIG. 1 illustrates a perspective view of a knuckle-protecting hand tool, such as a valve wrench device in accordance with the present invention.

Turning now to the drawings in more detail, numeral 10 designates the hand tool of the present invention, such as a knuckle-protecting wrench device. FIG. 1 illustrates a perspective view of a knuckle-protecting wrench device 10 in accordance with the present invention. The knuckle-protecting wrench device 10 includes a knuckle-protecting wrench handle 12, a gripping member, or wrench jaw 14 and a connecting member, or throat 16 integrated between the knuckle-protecting wrench handle 12 and the wrench jaw 14 to define a single unitary wrench body 11. In one aspect, the wrench jaw 14 is designed for use with a wheel valve 8.

The wrench jaw 14 comprises a generally circular configuration with an opening 24 into the circular configuration for receipt of the valve's bar 9. The wrench jaw 14 has a C-shape and is oriented to function similar as a claw around the valve's bar 9. The center axis of the wrench jaw 14 is perpendicular to the longitudinal axis of the single unitary wrench body 11.

The knuckle-protecting wrench handle 12 includes in general an elongated ring-shaped structure 18. As can be readily seen, the elongated ring-shaped structure 18 has two opposing handle sections 18*a* and 18*b* spaced apart. One end 18*c* of the ring-shaped structure 18 is integrated with or transitions into the throat 16. The connecting member 16 is created by the narrowing of the wrench body 11 between the knuckle-protecting wrench handle 12 and the wrench jaw 14. In this aspect, the throat 16 is narrowed symmetrically.

The elongated ring-shaped structure 18 provides an opening or slot 20 to receive or slip the user's fingers or a portion of the hand therethrough such as when the user grips one of the two handle sections 18*a*, 18*b* of the elongated ring-shaped structure 18. The other handle section 18*a*, 18*b* of the elongated ring-shaped structure 18 is in front of the knuckles. The end 18*d* of the knuckle-protecting wrench handle 12 which is opposite the throat 16 is closed by the continuous contour of the ring-shaped structure 18.

In the configuration of FIG. 1, the elongated ring-shaped structure 18 is essentially symmetrical along the longitudinal axis thereof. The handle sections 18*a* and 18*b* are slightly bowed or convexed toward a mid-point along the length of the sections 18*a* and 18*b*. Thus, the distance between the handle sections 18*a* and 18*b* at the mid-point is slightly shorter than the distance at ends 18*c* or 18*d*. Furthermore, the elongated ring-shaped structure 18 may also include one or more channels 26 in at least one of a top side and/or a bottom side thereof. A benefit of the one or more channels 26 is to remove material from the elongated ring-shaped structure 18 so that the weight of the wrench device 10 may be reduced.

The handle 18 can be used with other hand tools wherein protection of the user's hands is desired. Such conditions are often dictated by tight spaces that limit the user's ability to protect one or both hands while working with the hand tool.

Figure 3:
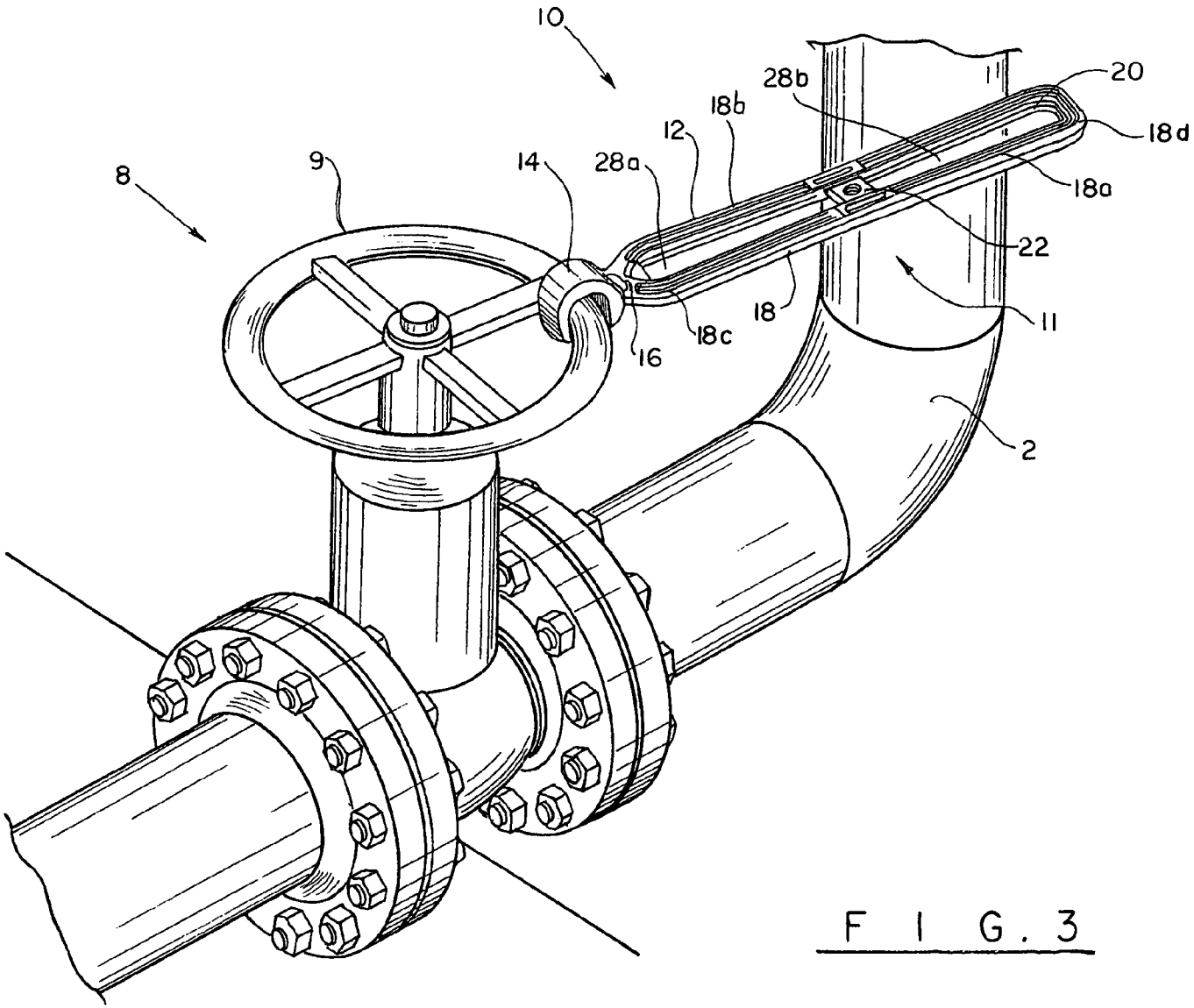
FIG. 3 illustrates a perspective view of the hand tool, such as a knuckle-protecting valve wrench device in accordance with the present invention coupled to a wheel valve in a refinery.
Figure 4:
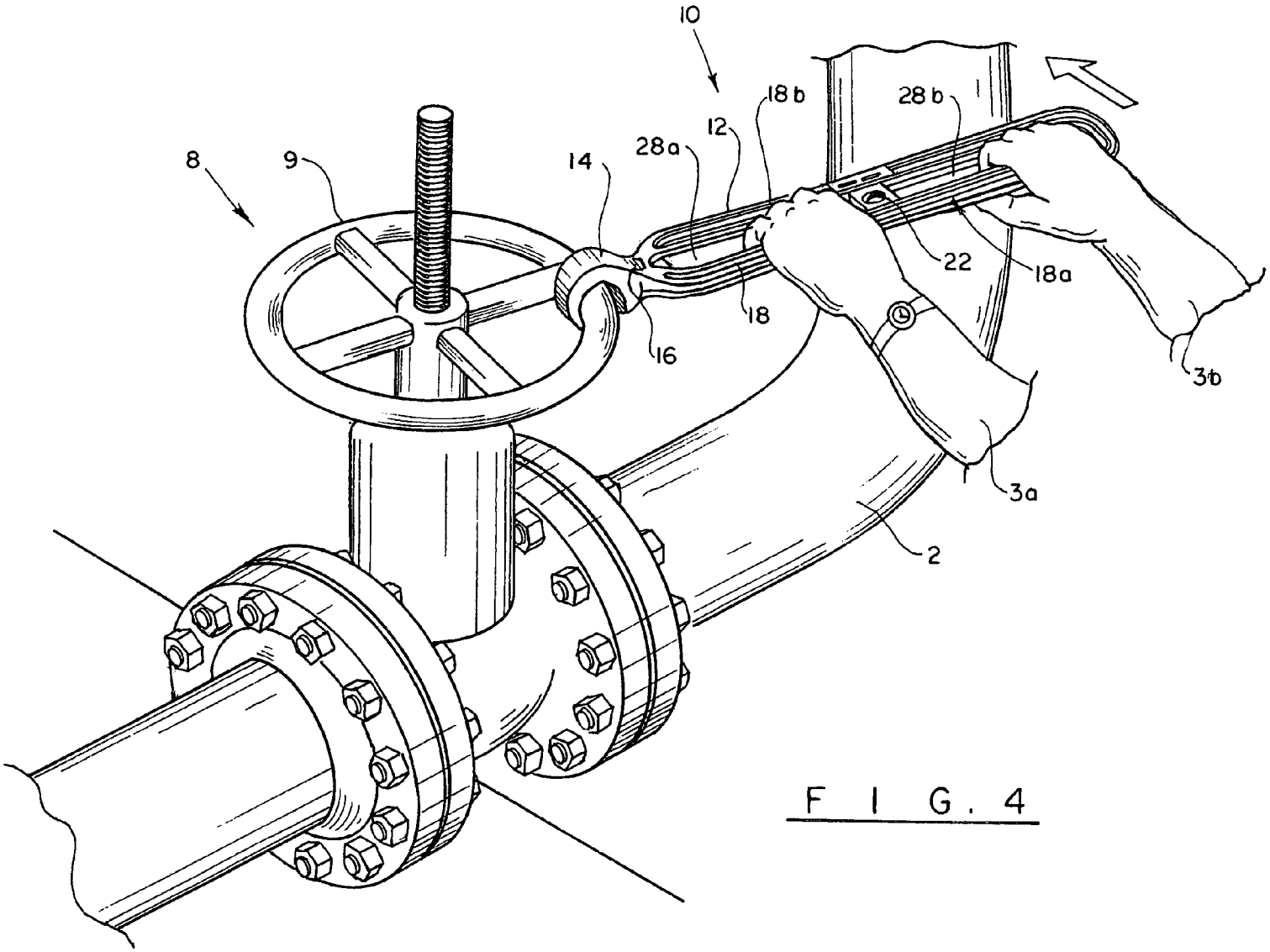
FIG. 4 illustrates a perspective view of the knuckle-protecting valve wrench device in accordance with the present invention coupled to a wheel valve and being gripped.

FIGS. 3 and 4 illustrates perspective views of the knuckle-protecting valve wrench device 10 coupled to a wheel valve 8. In FIG. 4, two hands 3*a* and 3*b* are used. In the exemplary configuration, the hollow or open center 20 is divided by a reinforcing member 22, which reinforces the handle in its narrow-most portion, while allowing the handle to be extended longitudinally. The longer handle creates a longer lever arm that is beneficial in a torque-applying tool as it requires less force to generate a torque action. Since the reinforcing member 22 is affixed to the handle sections it prevents separation of the long handle sections when the user pulls or pushes against the handle section.

Thus, two discrete knuckle-protecting slots 28*a* and 28*b* are created for the two separate hands 3*a* and 3*b*. In this configuration, the length of the knuckle-protecting wrench handle 12 allows two hands 3*a* and 3*b* to grip the knuckle-protecting wrench handle 12 side-by-side in the knuckle-protecting slots 28*a* and 28*b* to increase the leverage exerted by the user in an effort to turn the wheel valve 8 from inertia and in a direction to open the valve.

As a frame of reference, if the handle section 18*a* is used by the user to grip or grasp the knuckle-protecting wrench handle 12, then the knuckles are located within the hollow or open center 20 of the elongated ring-shaped structure 18. When the knuckles are located within the hollow or open center 20, the other handle section 18*b* precedes the knuckles. In operation, the handle section 18*b* that precedes the knuckles would strike an obstructing structure 2 or other nearby structures before the user's knuckles. Furthermore, as the handle section 18*b* strikes the nearby structure, the wrench device 10 is halted so that the knuckles remain protected.

Figure 2:
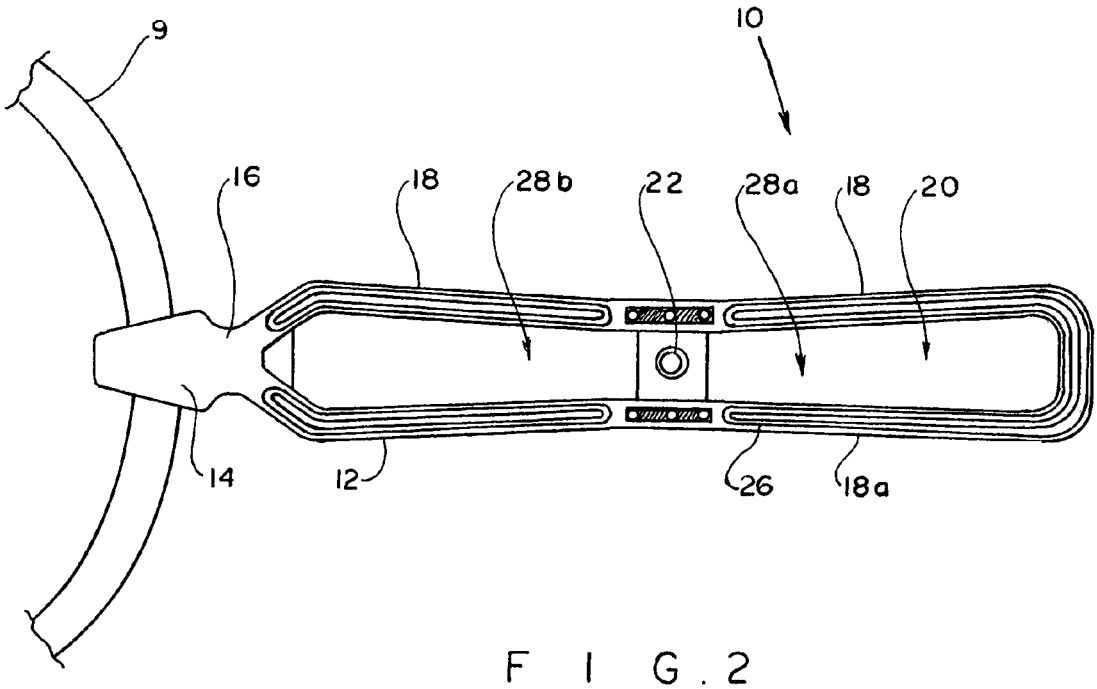
FIG. 2 illustrates a top view of the knuckle-protecting hand tool, such as a valve wrench device in accordance with the present invention coupled to a wheel valve.

FIG. 2 illustrates a top view of the knuckle-protecting valve wrench device 10 in accordance with the present invention coupled to a wheel valve 8. The contour of the wrench device 10 can be readily seen. The overall length of the wrench device 10 is approximately 23 inches. The width of the widest portion of the knuckle-protecting wrench handle 12 defined by Angle is approximately 3⅛ inches. The Angle is shown to represent that handle sections 18*a* and 18*b* are not completely parallel. The width of the jaw 14 is approximately 2½ inches.

As can be appreciated, the wrench device 10 is extremely valuable in emergency "turnaround" where the wheel valve 8 needs to be opened and eventually closed or vice versa in a rapid sequence. Of course most valves are subject to predicaments that occur at most chemical plants or processes where a multitude of valves are needed to provide the flow of the process materials from one vessel, or a state, or a reactor to another, as well as, the valve of various other components to treat the process to it or to react with it. In any event the flow of process material may take place in tubes or pipes adjacent the wheel valve 8 as best seen in FIGS. 3 and 4. Such tubes or pipes are obstructing structures 2 that the user may bang their knuckles or hands.

In a closed position, a gate is forced down against the actual bottom of its slide in a position set in an internal inside the valve body, just as with any type screw mechanism. Once a screw is set, to start an unscrewing motion in the opposite direction, after having someone type the screw in its closed position, may well take a fair amount of torque to start unscrewing (valve stem) the wheel valve 8 from inertia and in its opposite direction. In such a condition, the additional torque provided by the added weight to the wheel valve 8 using two hands on the wrench device 10 is advantageous to someone of less strength.

The turning of valve's bar 9 may be accomplished in a safer manner as facilitated by using the wrench device 10. The wrench device 10 basically prohibits the user from banging his knuckles/hands into another steel member (valve, pipe, supporting structure) closely associated and located adjacent to the wheel valve 8 being turned, such that a normal wrench leaves the operator exposed to damaging his knuckles/hands.

Figure 5:
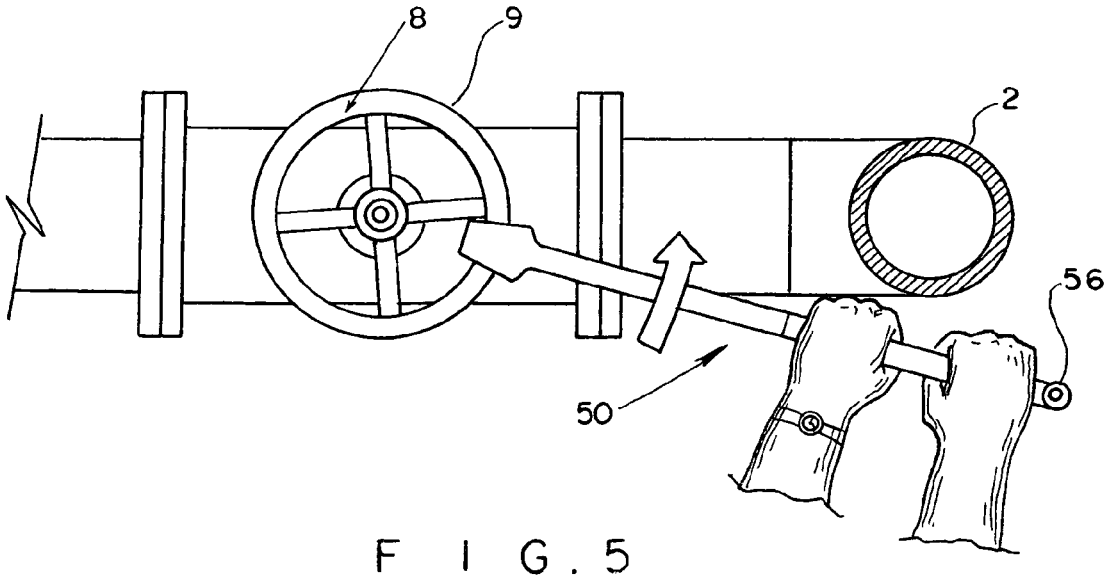
FIG. 5 PRIOR ART
FIG. 5 illustrates a view of a conventional valve wrench coupled to a valve's wheel and being gripped by a user.

FIG. 5 illustrates a view of a conventional valve wrench 50 coupled to a wheel valve 8 and being gripped by a user. As can be seen, the handle 56 of the wrench 50 leaves the user's hands and knuckles unprotected from another steel member (valve, pipe, supporting structure) closely associated and located adjacent to the wheel valve 8 being turned.

Figure 6:
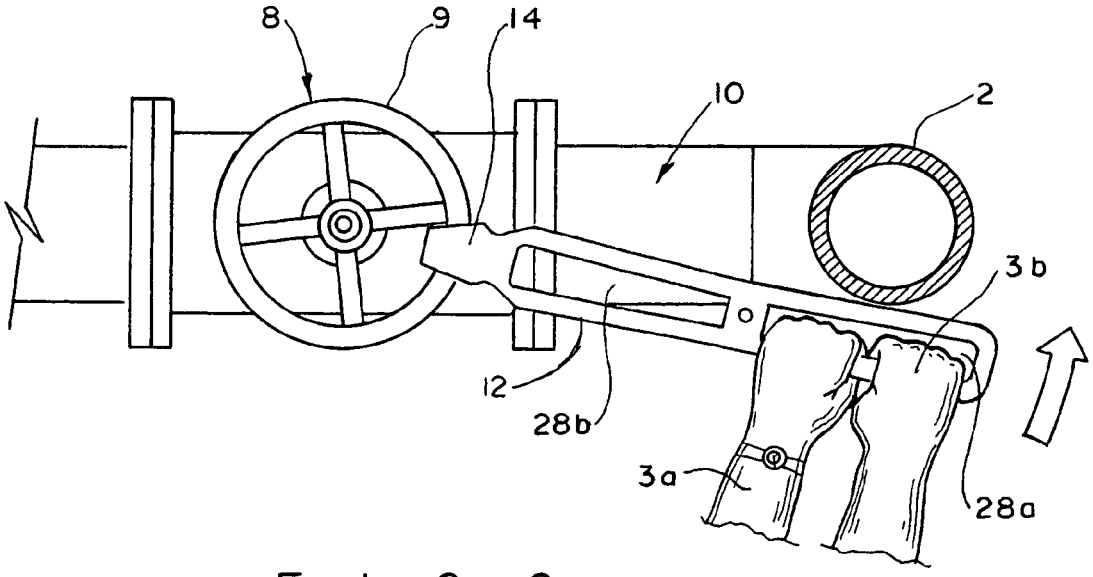
FIG. 6 illustrates a top view of the knuckle-protecting valve wrench device in accordance with the present invention coupled to a valve's wheel and being gripped by a user.

FIG. 6 illustrates a top view of the knuckle-protecting valve wrench device 10 in accordance with the present invention coupled to a wheel valve 8 and being gripped by a user. In this configuration, the user may grip both hands 3*a* and 3*b* in one of the knuckle-protecting slots 28*a* instead of the two slots 28*a* and 28*b*.

Figure 7:
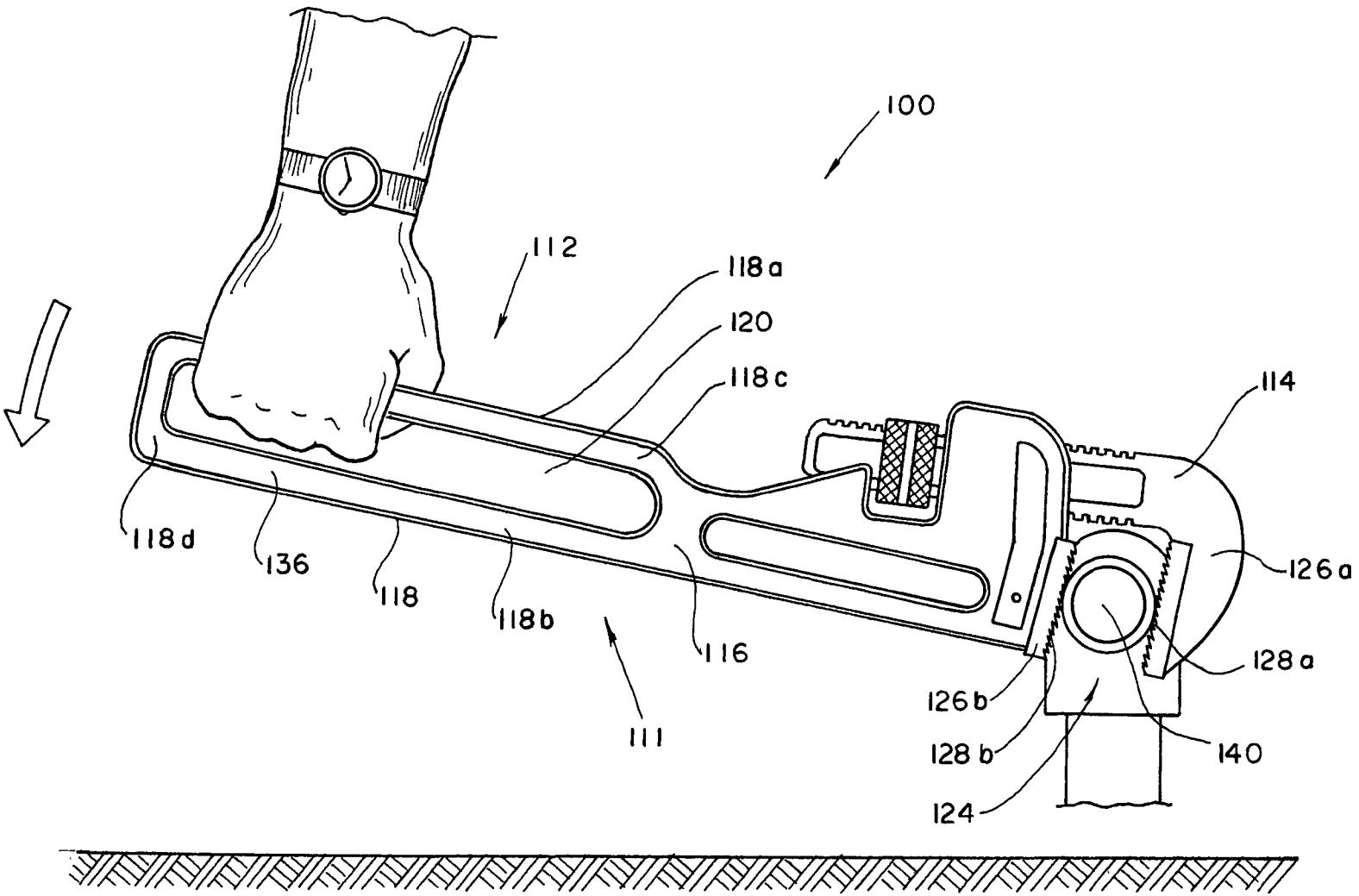
FIG. 7 illustrates an elevational view of a knuckle-protecting Stillson wrench device in accordance with the present invention coupled to a pipe.

FIG. 7 illustrates an elevational view of a knuckle-protecting wrench device 100 in accordance with the present invention. The knuckle-protecting wrench device 100 includes a knuckle-protecting wrench handle 112, a Stillson gripping member, or wrench jaw 114 and a connecting member, or throat 116 coupled between the knuckle-protecting wrench handle 112 and the Stillson wrench jaw 114. In one aspect, the wrench jaw 114 is designed for use with pipes 140 but may be used with fasteners including hexagonal or polygonal shaped fastener heads or nuts.

The Stillson wrench jaw 114 comprises an adjustable wrench jaw with an opening 124 for receipt of the pipe 140. The Stillson wrench jaw 114 has two serrated jaw members 126*a* and 126*b* with serrations 128*a* and 128*b*, respectively. The jaw members 126*a* and 126*b* may be adjusted to grip the pipe 140. The upper jaw member 126*a* is movable in relation to the fixed location of the lower jaw member 126*b*. The upper jaw member 126*a* has an L-shaped.

The knuckle-protecting wrench handle 112 includes in general an elongated ring-shaped structure 118. As can be readily seen, the elongated ring-shaped structure 118 has two opposing handle sections 118*a* and 118*b* spaced apart. One end 118*c* of the ring-shaped structure 118 is integrated with or transitions into the connecting member, or throat 116. The throat 116 is created by the narrowing of the wrench body 111 between the knuckle-protecting wrench handle 112 and the wrench jaw 114. The configuration of the throat 116 is narrowed along one side, generally, the side opposite the opening 124.

The elongated ring-shaped structure 118 provides an opening or slot 120 to receive or slip the user's fingers or a portion of the hand therethrough such as when the user grips one of the two handle sections 118*a*, 118*b* of the elongated ring-shaped structure 118. The other handle section 118*a*, 118*b* of the elongated ring-shaped structure 118 is in front of the knuckles. The end 118*d* of the knuckle-protecting wrench handle 112 which is opposite the throat 116 is closed by the continuous contour of the ring-shaped structure 118. In this configuration, there is only one knuckle-protecting slot denoted by 120.

In this configuration as the pipe 140 is being rotated, the user may grasp handle section 118*a* opposite the side of the opening 124 of the wrench jaw 114. In one aspect, the wrench body 111 is elongated above the throat 116 to accommodate the adjusting gears of the Stillson wrench jaw 114 and includes an opening. The wrench body 111 may have a one or more channels 136 formed therein. The Stillson wrench jaw 114 has self-tightening properties and hard serrated jaws that are adapted to securely grip pipes and pipe fittings.

Figure 8:
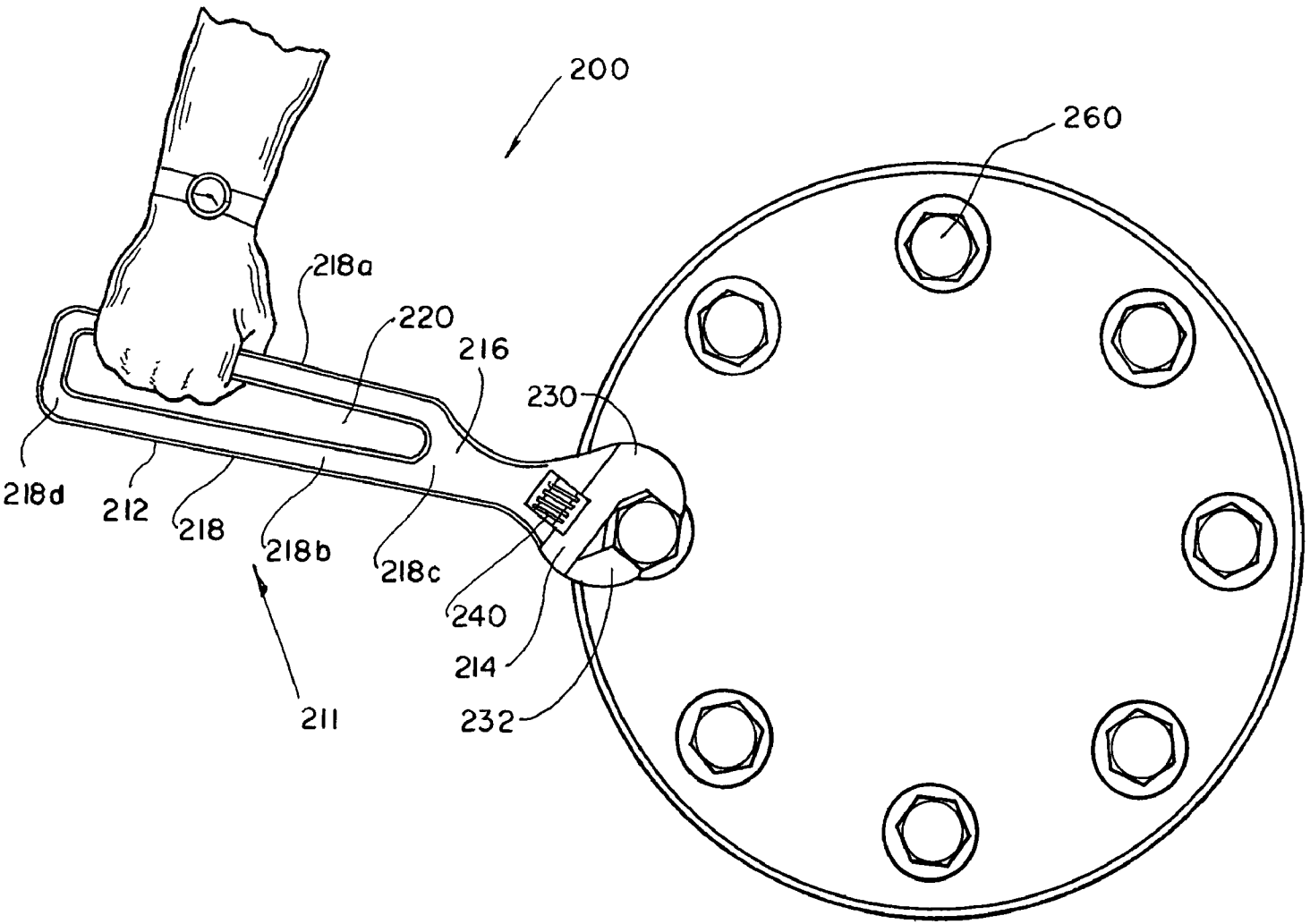
FIG. 8 illustrates a knuckle-protecting open-ended adjustable wrench device in accordance with the present invention coupled to a fastener head.

FIG. 8 illustrates a knuckle-protecting open-ended adjustable wrench device 200 in accordance with the present invention coupled to a fastener head 260. The knuckle-protecting wrench device 200 includes a knuckle-protecting wrench handle 212, an adjustable gripping member, or wrench jaw 214 and a throat 216 coupled between the knuckle-protecting wrench handle 212 and the adjustable wrench jaw 214. The knuckle-protecting open-ended adjustable wrench device 200 may be a Crescent wrench.

In one aspect, the adjustable wrench jaw 214 is designed for use with fasteners including hexagonal or polygonal fastener heads 260 and nuts. The adjustable jaw 214 comprises a stationary jaw member 230 and a movable jaw member 232 having a worm (NOT SHOWN) at a lower portion thereof. The movable jaw member 232 is movable transversely away from and toward the stationary jaw member 230. The adjustable wrench jaw 214 includes a driving mechanism 240 such as a worm gear with a worm gear shaft constructed and arranged to engage the worm of the movable jaw member 232.

The knuckle-protecting wrench handle 212 includes in general an elongated ring-shaped structure 218. As can be readily seen, the elongated ring-shaped structure 218 has two opposing handle sections 218*a* and 218*b* spaced apart. One end 218*c* of the ring-shaped structure 218 is integrated with or transitions into the connecting member, or throat 216. The throat 216 is created by the narrowing of the wrench body 211 between the knuckle-protecting wrench handle 212 and the wrench jaw 214. The configuration of the throat 216 is narrowed and has a longer length then the configuration of FIG. 1.

The elongated ring-shaped structure 218 provides an opening or slot 220 to receive or slip the user's fingers or a portion of the hand therethrough such as when the user grips one of the two handle sections 218*a*, 218*b* of the elongated ring-shaped structure 218. The other handle section 218*a*, 218*b* of the elongated ring-shaped structure 218 is in front of the knuckles. The end 218*d* of the knuckle-protecting wrench handle 212 which is opposite the throat 216 is closed by the continuous contour of the ring-shaped structure 218.

In this configuration, there is a single opening or slot to protect the knuckles.

Figure 9:
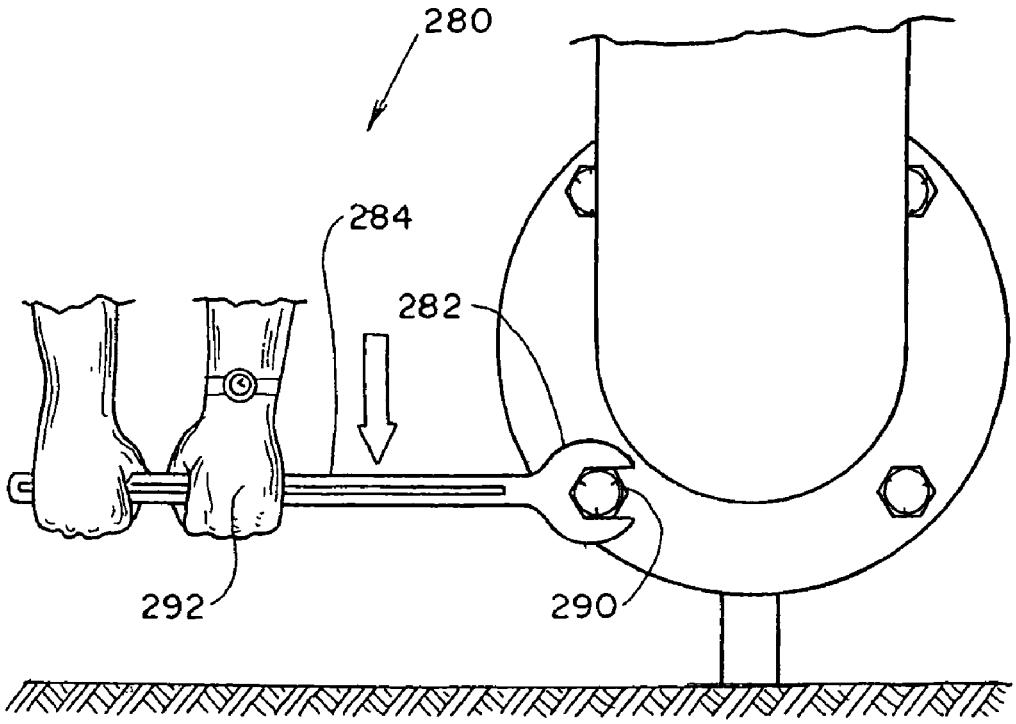
PRIOR ART F I G. 9
FIG. 9 illustrates a conventional open-ended wrench coupled to a fastener head.

FIG. 9 illustrates a conventional open-ended wrench 280 coupled to a fastener head 290. The conventional open-ended wrench 280 includes a wrench handle 284 and a fixed U-shaped jaw 282. The user's hands 292 are shown gripping the handle 284, said handle 284 providing no means of protection to the user's hands 292.

Figure 10:
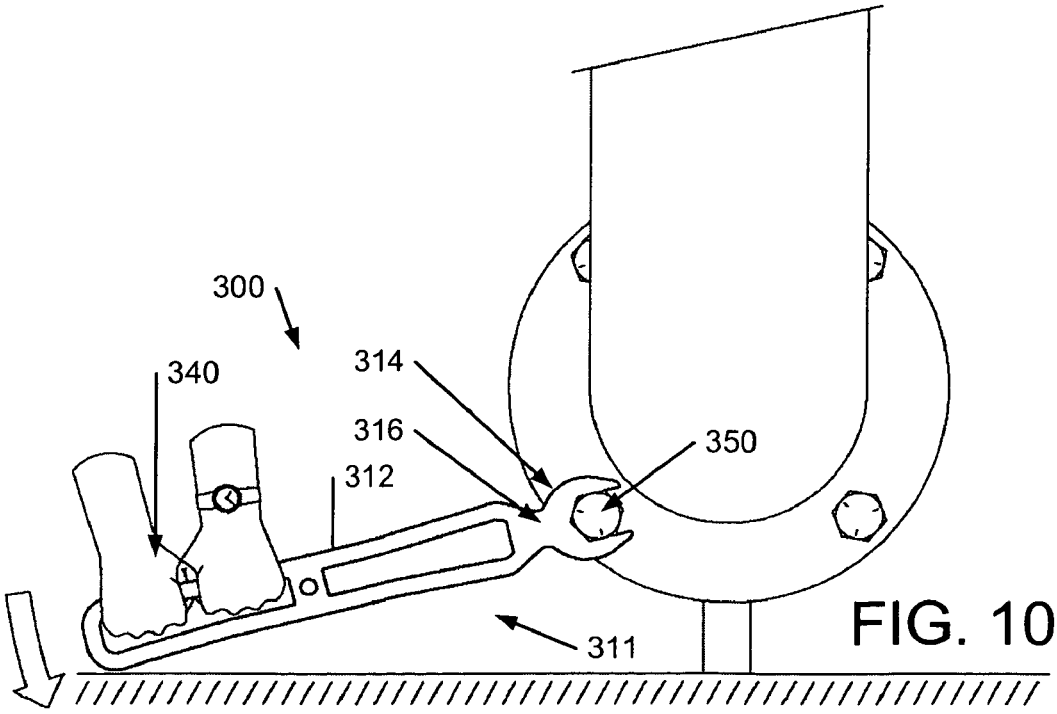
FIG. 10 illustrates an elevational view of a knuckle-protecting open-ended wrench device in accordance with the present invention coupled to a fastener head.

FIG. 10 illustrates an elevational view of a knuckle-protecting open-ended wrench device 300 in accordance with the present invention coupled to a fastener head 350. The knuckle-protecting open-ended wrench device 300 includes a knuckle-protecting wrench handle 312, a fixed open-ended gripping member, or wrench jaw 314 and a throat 316 integrated between the knuckle-protecting wrench handle 312 and the wrench jaw 314 to define a single unitary wrench body 311. In one aspect, the wrench jaw 314 is designed for use with hexagonal fasteners 350.

The knuckle-protecting handle 312 has a similar construction as the knuckle-protecting wrench handle 12 of FIG. 1. Therefore, no further description will be provided. In operation, the user may place both hands 340 in one of the knuckle-protecting slots. However, both knuckle-protecting slots may be used as needed.

As can be readily seen, the use of the knuckle-protecting open-ended wrench device 300 serves to protect the user's knuckles and hands from nearby structures or floors if engaged during use of the knuckle-protecting open-ended wrench device 300. The handle sections may be arranged in parallel or non-parallel relationship. The handle sections may be straight, or slightly convex (concave), or they may extend at an angle in relation to each other.

Furthermore, the hand tools 10, 100, 200 and 300 may be impacted by hammers to increase the initial start of the torque to open the valve. The configurations with the two knuckle-protecting slots (such as 28*a* and 28*b*) allow the user to use one slot to protect their hands from impact by the hammer.

The wrench devices 10, 100, 200 and 300 described herein above may be made of steel or aluminum. The handle of this invention is not limited to the use in a wrench device having a gripping jaw, and can be used with other hand tools.

Many changes and modifications can be made in the design of the present invention without departing from the spirit thereof. I, therefore, pray that my rights to the present invention be limited only by the scope of the appended claims.

I claim:

1. A hand tool device comprising:

an elongated handle having a pair of opposing unitary connected handle sections defining an elongated central opening therebetween, said opening being sized and configured to receive a user's hand therein when a user grips by hand one of the handle sections;

a reinforcing member secured between the handle sections in said central opening;

a gripping member; and a solid connecting member positioned between and integrated with the handle and the gripping member, said connecting member having smaller lateral dimensions than the handle and the gripping member wherein said central opening has a first end distant from said gripping member, a second end proximate to said gripping member and a central portion located between the first end and the second end, and wherein a distance between the handle sections in said central portion is at least slightly less than a distance between the handle sections adjacent the first end of the central opening.

2. A hand tool device comprising:

an elongated handle having a pair of opposing unitary connected handle sections defining an elongated central opening therebetween, said opening being sized and configured to receive a user's hand therein when a user grips by hand one of the handle sections;

a reinforcing member secured between the handle sections in said central opening;

a gripping member; and a solid connecting member positioned between and integrated with the handle and the gripping member, said connecting member having smaller lateral dimensions than the handle and the gripping member, wherein said central opening has a first end distant from said gripping member, a second end proximate to said gripping member and a central portion located between the first end and the second end, and wherein a distance between the handle sections in said central portion is at least slightly less than a distance between the handle sections adjacent the second end of the central opening.

3. A wrench device comprising:

an elongated handle having a pair of opposing unitary connected non-parallel handle sections defining an elongated opening therebetween, said opening being sized and configured to receive a user's hand therein when a user grips;

a reinforcing member secured between the handle sections in said central opening and extending transversely to longitudinal axes of the handle sections;

a wrench jaw; and a solid connecting member positioned between and integrated with the handle and the wrench jaw, said connecting member having smaller lateral dimensions than the handle and the gripping member, wherein said central opening has a first end distant from said jaw, a second end proximate to said jaw and a central portion located between the first end and the second end, and wherein a distance between the handle sections in said central portion is at least slightly less than a distance between the handle sections adjacent the first end of the central opening.

4. The device of claim 3, wherein said reinforcing member is positioned substantially at a mid point of the central opening.

5. The device of claim 3, wherein said central opening has a first end distant from said jaw and a second end proximate to said jaw, and wherein a distance between the handle sections in said second end is at least slightly greater than a distance between the handle sections in the second end of the central opening.

6. The device of claim 3, wherein said handle is configured as a ring-shaped body unitary secured to the connecting member.

7. A valve wrench device comprising:

an elongated handle having a pair of opposing unitary connected non-parallel handle sections defining at least one elongated opening therebetween, said at least one opening being sized and configured to receive a user's hand therein when a user grips one of the handle sections, each of said handle sections having a proximate end and a distal end, and a bowed configuration curving toward a mid-point along a length of the handle sections;

a wrench throat formed by joined proximate ends of the handle sections, said wrench throat having lateral dimensions smaller than lateral dimensions of the handle; and a wrench jaw unitary connected to the wrench throat opposite the handle, said wrench jaw being configured to engage a wheel of a valve.

8. The device of claim 7, further comprising a reinforcing member mounted between the handle sections and traversing said at least one opening a distance from said wrench throat.

9. The device of claim 7, wherein said handle sections each have a first surface and a second surface, and wherein a plurality of channels is formed in said first surface.

10. The device of claim 9, wherein said wrench jaw is provided with an opening, said opening being oriented away from the first surface.

* * * * *